United States Patent [19]

Guhde

[11] 4,152,176

[45] May 1, 1979

[54] METHOD OF PREPARING TITANIUM-CONTAINING PHOSPHATE CONDITIONER FOR METAL SURFACES

[75] Inventor: Donald J. Guhde, Euclid, Ohio

[73] Assignee: R. O. Hull & Company, Inc., Ohio

[21] Appl. No.: 931,373

[22] Filed: Aug. 7, 1978

[51] Int. Cl.[2] ..... C23F 7/08

[52] U.S. Cl. ..... 148/6.15 R; 148/6.15 Z; 106/299; 252/135

[58] Field of Search ..... 423/305, 306; 106/73.3, 106/299; 148/6.15 R, 6.15 Z; 252/135, 136

[56] References Cited

U.S. PATENT DOCUMENTS

| | | | |
|---|---|---|---|
| 2,310,239 | 2/1943 | Jernstedt | 148/6.15 Z |
| 2,516,008 | 7/1950 | Lum | 148/6.15 Z |
| 2,743,205 | 4/1956 | Condon | 148/6.15 Z |
| 2,874,081 | 2/1959 | Cavanagh | 148/6.15 Z |

*Primary Examiner*—Ralph S. Kendall
*Attorney, Agent, or Firm*—Maky, Renner, Otto & Boisselle

[57] ABSTRACT

The present invention relates to an improved method of preparing titanium-containing phosphate conditioners useful in cleaning and activating the surface of ferrous, zinc or aluminum metal and alloys thereof for subsequent reaction with phosphate coating solutions. The method comprises the steps of (a) preparing a mixture consisting essentially of water, sodium tripolyphosphate, disodium phosphate and a titanium-containing compound and (b) adding said mixture to solid disodium phosphate with mixing whereby a solid titanium phosphate composition is obtained.

The invention provides a method for forming a dry activating composition which does not require the application of any energy such as heat to the material. When the solid titanium phosphate compound is dissolved in water to form pretreatment solutions it can be employed successfully for activating metal surfaces in preparation for reaction with phosphate coating solutions.

11 Claims, No Drawings

METHOD OF PREPARING TITANIUM-CONTAINING PHOSPHATE CONDITIONER FOR METAL SURFACES

BACKGROUND OF THE INVENTION

The present invention relates to a method of preparing titanium-containing compositions useful in cleaning and activating the surface of ferrous, zinc or aluminum metal and alloys thereof for subsequent reaction with phosphate coating solutions. More particularly, the invention relates to an improved method for preparing solid titanium-containing compositions which does not require the application of any heat to form the dry solid activating compositions.

In the formation of protective phosphate coatings on surfaces of metals, it has been recognized that in many cases, the metal surfaces react slowly with the applied phosphating compositions so that the process may take longer than desired. It also is known that the desirable properties of the phosphate coatings such as corrosion resistance and adhesion of paint films thereto are diminished by incomplete or defective phosphate coatings or by phosphate coatings improperly applied and which are characterized by a coarse, loosely packed crystal structure.

It is desirable, therefore, that the metals be given some type of conditioning pretreatment prior to phosphating to remove contaminants from the surface such as oils, greases and dirts and to activate the metal surfaces so that when the metal surface is immersed in a conventional phosphating solution, there will be produced thereon a fine crystalline coating of phosphate which substantially covers all of the treated surfaces. Solutions which clean and activate the metal surfaces prior to phosphating are desirable and have been described in the prior art.

U.S. Pat. No. 2,743,205 describes an aqueous solution for treating metal surfaces to render them more active on subsequent formation of phosphate coatings thereon which comprises a mixture of a lithium compound and an alkali orthophosphate. The activating compound is prepared by first dissolving a lithium compound and an alkali orthophosphate in water followed by evaporation to dryness.

It also has been suggested that cleaned sheet steel may be pretreated with an activating composition composed of an aqueous solution containing disodiuum orthophosphate and a small amount of an activating metal such as titanium. U.S. Pat. No. 2,516,008 describes activating and cleaning compositions obtained by combining (a) an activating composition composed of disodium orthophosphate and an activating compound of a metal selected from the group consisting of titanium, zirconium, lead and tin, (b) an organic carboxylic acid stabilizer, and (c) an alkaline cleaning composition suitable for cleaning metal surfaces.

U.S. Pat. No. 2,310,239 describes activating compositions comprising disodium phosphate and a titanium compound, and U.S. Pat. No. 2,456,947 describes activating agents which comprise an aqueous solution of disodium phosphate and a water soluble compound of a multivalent metal such as titanium, zirconium, tin and arsenic. British Pat. No. 1,362,031 describes activating compositions for use in metal cleaning liquids which comprises a mixed orthophosphate of titanium and at least one divalent metal selected from the group consisting of barium, strontium and calcium in which the number of equivalents of titanium present does not exceed the number of equivalents of the divalent metal.

U.S. Pat. No. 2,874,081 describes a method for preparing titanium-containing pretreatment solutions having improved activity by controlling the conditions under which the titanium phosphate composition is prepared. The controls include, among other conditions, low temperature initial dispersion of the essential ingredients followed by a subsequent higher temperature aging treatment and drying.

SUMMARY OF THE INVENTION

The present invention provides a method of preparing solid titanium-containing phosphate compositions useful as cleaners and activating agents in metal cleaning liquids which does not require any drying step utilizing external energy sources such as heat. The method of the invention comprises the steps of (a) preparing a mixture consisting essentially of water, sodium tripolyphosphate, disodium phosphate and a titanium-containing compound at a temperature of from about 65° to about 95° C., and (b) adding said mixture to solid disodium phosphate with mixing whereby a solid titanium phosphate composition is obtained. The solid composition, when added to cleaning solutions applied to metal surfaces, results in metal surfaces which can be coated readily with aqueous phosphating solutions to provide desirable phosphate coatings.

DESCRIPTION OF THE PREFERRED EMBODIMENTS

As mentioned above, the method of the invention comprises the steps of first preparing a mixture consisting essentially of water, sodium tripolyphosphate, disodium phosphate and a titanium-containing compound and adding this mixture to solid disodium phosphate with mixing whereby a solid titanium phosphate composition is obtained. Generally, the mixture prepared in the first step will contain from about 25 to about 35 parts of water, about 12 to 25 parts of sodium tripolyphosphate, about 25 to 50 parts of disodium phosphate and about 0.02 to ten parts of a titanium-containing compound.

A variety of titanium-containing compounds can be used in the method of the invention. Almost any water soluble salt of titanium can be used so long as the anion does not interfere with the cleaning action or subsequent phosphating procedure. Examples of useful titanium compounds include titanium halides, titanium oxalate and titanium sulfate. Although the source of the titanium ion is not critical, titanium halides and particularly titanium fluorides are preferred in the method of the invention. Examples of the halides include titanium tetrachloride, titanium trichloride, and titanium potassium fluoride.

The relative amounts of the ingredients used to form the mixture in step (a) may be varied within the ranges given, and generally, the amounts of sodium tripolyphosphate and disodium phosphate included in the mixture will be sufficient to form a mixture having a pH of from about 6.5 to about 8 and will be sufficient further to provide a solid titanium phosphate composition capable of forming aqueous solutions having a pH of from about 7.0 to about 8. The solid titanium phosphate composition produced in accordance with the method of the invention also may be characterized generally as containing from about 0.005% to about 2% of titanium based on the combined weight. The amount of water in the final solid product may vary, but in one preferred embodiment, the solid titanium phosphate composition produced in accordance with the method of the invention contains about 15% water.

In general, the method of preparing solid titanium phosphate compositions in accordance with this invention comprises the addition of sodium tripolyphosphate to water which is heated to a temperature of between about 65° to 95° C. whereupon the titanium-containing compound is added while maintaining the mixture at the desired temperature. After thorough mixing in a blender (about 3 to 10 minutes), the disodium phosphate is added and blended into the mixture at the desired temperature for a period of from about 5 minutes to one hour or more.

This mixture may then be added to solid disodium phosphate either while hot, or the mixture may be precooled. The amount of solid disodium phosphate should be sufficient to produce a dry powder when thoroughly blended with the above mixture and cooled.

As mentioned above, the relative amounts of the ingredients used in the preparation of the solid titanium phosphate composition can be varied but should be controlled to produce a product which is a solid without the need of any drying operation. As an example of a preferred embodiment of the invention, 35.2 parts (all parts by weight) of water and 12.6 parts of sodium tripolyphosphate is blended in a Cowles dissolver at 5800 r.p.m. at a temperature of from about 65°–70° C. for about five minutes whereupon 2.6 parts of titanium potassium fluoride is added to the mixture. This mixture is heated at 70° C. for five minutes, and 49.6 parts of disodium phosphate is added. The contents of the blender are heated to and maintained at a temperature of about 75°–80° C. for approximately 15 minutes. The temperature of the mixture rises slowly to about 88° C. This mixture, which is a slurry, is added slowly to 100 parts of anhydrous disodium phosphate with good mixing and cooling. The solid product is crushed to produce a dry powder containing about 15% moisture.

In one variation of the above procedure, the slurry is cooled to room temperature prior to addition to the solid anhydrous disodium phosphate. When the slurry is precooled, it is somewhat easier to control the exothermic reaction obtained when the slurry is mixed with the anhydrous disodium phosphate.

The titanium-containing phosphate compositions prepared in accordance with the process of this invention are useful in cleaning and activating the surfaces of ferrous, zinc or aluminum metals and alloys thereof particularly for subsequent reaction with phosphate coating solutions. The solid titanium-containing phosphate compositions can be dissolved in water to form pretreatment solutions of different desirable concentrations. Thus, useful aqueous pretreatment solutions can be prepared containing a titanium ion concentration between about 0.0004% and 0.05% and from about 0.01% to 2% of the sodium phosphates. An example of a workable activating solution is prepared by dissolving about one gram of the solid titanium phosphate composition in about one liter of water. The metal surfaces are cleaned and conditioned by treating the surfaces with the activating solution such as by immersion or in a spray line while maintaining the solution at a temperature of from about 35°–50° C., although this temperature may be varied as known to those skilled in the art. After the metal surface has been treated with the activating solution until clean, usually for a short period of time, the metal surface is subjected to a water rinse at about 50° C. to remove any materials present which may not be desirable when the surfaces are subjected to phosphate coating compositions. When ferrous, zinc or aluminum metal surfaces are cleaned and activated by the method described above, improved quality phosphate coatings can be applied to the activated surfaces utilizing phosphating compositions and techniques well known in the art.

The solid titanium-containing phosphate conditioner may be added to aqueous solutions containing cleaning compounds normally used for cleaning metal surfaces such as sodium silicates, sodium phosphates, wetting agents. The concentration of the titanium-containing phosphate conditioner compound in activating solutions for treating metal surfaces can range between 5% to about 25%.

In one preferred example, a slurry containing about 4.5 to about 9 kilograms of the titanium-containing compositions in about 190 liters of water is metered into the last rinse solution just ahead of the phosphating stage. The conditioning treatment at this stage results in a phosphate coating having excellent characteristics.

The embodiments of the invention in which an exclusive property or privilege is claimed are defined as follows:

1. A method of preparing a solid titanium-containing phosphate composition which comprises the steps of:

(a) preparing a mixture consisting essentially of water, sodium tripolyphosphate, disodium phosphate and a titanium-containing compound at a temperature of from about 65° to about 95° C., and (b) adding said mixture to solid disodium phosphate with mixing whereby a solid titanium phosphate composition is obtained.

2. The method of claim 1 wherein the mixture in step (a) is prepared from about 25 to about 35 parts of water, about 12 to 25 parts of sodium tripolyphospate, about 25 to 50 parts of disodium phosphate, and about 0.02 to 10 parts of the titanium compound.

3. The method of claim 2 wherein the mixture is added to sufficient solid disodium phosphate to form a solid titanium phosphate composition containing about 15% water.

4. The method of claim 1 wherein the titainum-containing compound is a titanium halide.

5. The method of claim 4 wherein the titanium halide is a titanium fluoride.

6. The method of claim 5 wherein the titanium fluoride compound is titanium potassium fluoride.

7. The method of claim 1 wherein the amounts of tripolyphoshate and disodium phosphate included in the mixture prepared in step (a) are sufficient to form a mixture having a pH of from about 6.5 to about 8.

8. The method of claim 1 wherein the amounts of sodium tripolyphosphate and disodium phosphate used to prepare the mixture of step (a) are sufficient to provide a solid titanium phosphate composition which, when dissolved in deionized water, produces aqueous solutions having a pH of from about 7.0 to about 8.

9. The method of claim 1 wherein the solid titanium phosphate composition obtained in step (b) contains about 0.005% to 2% of titanium based on the combined weight.

10. The titanium-containing phosphate composition prepared in accordance with the method of claim 1.

11. A method of treating surfaces of ferrous, zinc or aluminum metal and alloys thereof to produce phosphate coatings thereon which comprises contacting said surfaces with an aqueous solution comprising a titanium-containing phosphate composition prepared in accordance with the method of claim 1 and thereafter contacting said surface with an aqueous acidic phosphate solution to form a phosphate coating thereon.

* * * * *